US009376198B2

(12) United States Patent
Anderson

(10) Patent No.: US 9,376,198 B2
(45) Date of Patent: Jun. 28, 2016

(54) SERVICEABLE MARINE POD STEERING BRAKE SYSTEM

(71) Applicant: Caterpillar Inc., Peoria, IL (US)

(72) Inventor: Justin Anderson, Racine, WI (US)

(73) Assignee: Caterpillar Inc., Peoria, IL (US)

( * ) Notice: Subject to any disclaimer, the term of this patent is extended or adjusted under 35 U.S.C. 154(b) by 27 days.

(21) Appl. No.: 14/464,792

(22) Filed: Aug. 21, 2014

(65) Prior Publication Data

US 2016/0052613 A1 Feb. 25, 2016

(51) Int. Cl.

| | |
|---|---|
| ***B63H 25/48*** | (2006.01) |
| ***B63H 25/42*** | (2006.01) |
| ***B63H 5/125*** | (2006.01) |
| *B63H 25/10* | (2006.01) |
| *B63H 5/10* | (2006.01) |

(52) U.S. Cl.

CPC ..... *B63H 25/42* (2013.01); *B63H 5/125* (2013.01); *B63H 5/1252* (2013.01); *B63H 5/10* (2013.01); *B63H 2005/1254* (2013.01); *B63H 2005/1256* (2013.01)

(58) Field of Classification Search

CPC ..... B63H 25/00; B63H 25/42; B63H 5/125; B63H 2005/07; B63H 2005/125; B63H 2005/1254; B63H 2005/1258

USPC ..... 114/144 R, 144 RE, 144 B, 145 R; 440/53, 57, 58, 61 S, 61 A, 75, 76, 78, 440/79

See application file for complete search history.

(56) References Cited

U.S. PATENT DOCUMENTS

| | | | | |
|---|---|---|---|---|
| 1,360,276 | A | 11/1920 | Eaton | |
| 1,577,919 | A | 3/1926 | McNab | |
| 1,603,867 | A | 10/1926 | Rogers | |
| 2,102,512 | A | 12/1937 | Chance | |
| 2,112,490 | A | 3/1938 | Hill | |
| 3,548,775 | A * | 12/1970 | Horn | G05D 1/0208 144/144 B |
| 3,976,023 | A * | 8/1976 | Noguchi | B63H 21/213 144/144 E |
| 4,611,549 | A * | 9/1986 | Kodera | B63H 25/42 114/144 E |
| 4,614,900 | A * | 9/1986 | Young | B63H 20/007 114/144 R |
| 5,491,636 | A * | 2/1996 | Robertson | B63H 25/42 114/144 B |
| 6,688,927 | B2 | 2/2004 | Aarnivuo | |
| 8,408,953 | B2 | 4/2013 | Bremsjo et al. | |

* cited by examiner

*Primary Examiner* — Daniel V Venne
(74) *Attorney, Agent, or Firm* — L. Glenn Waterfield

(57) ABSTRACT

A steering system for a marine vessel includes a lower pod unit rotatably mounted to an upper pod unit. The upper pod unit includes a servo motor and a steering brake. The steering system includes a controller electrically connected to the servo motor and the steering brake. Upon receiving a first signal, the servo motor provides torque to rotate the lower pod unit. The steering brake is configured to provide a braking force to prevent rotation of said lower pod unit when no signal is received from said controller. The controller sends a first signal to said servo motor to command rotating torque and sends a second signal to said steering brake to release braking force. A service harness connector is provided that is manually connected in place of the servo harness connector.

20 Claims, 3 Drawing Sheets

SERVICEABLE MARINE POD STEERING BRAKE SYSTEM

TECHNICAL FIELD

The present disclosure relates to a serviceable steering system for a pod, or azimuth thruster, for a marine vessel. The steering system includes a steering brake that prevents rotation of the lower pod unit unless a controller has commanded steering. The steering system further provides a service connector that disengages the steering brake.

BACKGROUND

A marine vessel may be equipped with a pod, or azimuth thruster propulsion system. The pod provides both propulsion and steering functions and may be used singly or in pairs. The pod is made up of two units. The first, the upper pod unit, connects to an engine via a driveshaft and contains the gearing and steering functions. The second, the lower pod unit, mounts a propeller and provides an exhaust outlet for the engine. The lower pod unit is external of the hull of the marine vessel and rotates relative to the upper pod unit to provide steering.

The steering system typically includes a steering brake that prevents rotation of the lower pod unless a steering operation is underway. The steering brake will typically be engaged to prevent rotation unless the brake receives a signal to disengage to allow a turning operation. Such a system is disclosed in U.S. Pat. No. 8,408,953 to Bremsjo; et al., issued Apr. 2, 2013, entitled "Arrangement and method for controlling a propeller drive on a boat." The steering system and steering brake may need periodic servicing. During service, the steering brake may need to be disengaged to allow the lower pod unit to rotate freely. In addition, it may be desirable to service the steering system without the chance of having the lower pod unit perform an uncommanded rotation while a serviceman is in the vicinity.

The system disclosed by Bremsjo et al does not disclose a system or method that allows servicing of the steering and brake system.

SUMMARY OF THE INVENTION

In one aspect of the current disclosure, a serviceable steering system for a marine pod unit is provided. The serviceable steering system comprises an upper pod unit mounted to a hull of a marine vessel and including a servo motor and a steering brake. The system also comprises a lower pod unit rotatably mounted to said upper pod unit and including a prop section, and a controller electrically connected to said servo motor and to said steering brake via a servo harness connector mated to a servo connector. The servo motor is configured to provide torque for rotating said lower pod unit relative to said upper pod unit upon receiving a first signal from said controller via said servo harness connector. The system further comprises a steering brake configured to provide a braking force to prevent rotation of said lower pod unit when no signal is received, release braking force upon receiving a second signal from said controller via said servo harness connector, and release braking force upon receiving a third signal from a service harness connector, wherein said service harness connector is manually connected in place of said servo harness connector.

In another aspect of the current disclosure, a harness configuration for a steering system for a marine pod unit having an upper pod unit mounted to the hull of a marine vessel and including a servo motor and a steering brake, and a lower pod unit rotatably mounted to said upper pod unit is provided. The harness configuration comprises a servo harness connector configured to connect to a servo connector and provide a first signal from a controller to said servo motor, said servo motor configured to provide torque for rotating said lower pod unit relative to said upper pod unit. The harness connector is further configured to connect to said servo connector and provide a second signal from said controller to release said service brake, said service brake configured to provide a braking force to prevent rotation of said lower pod unit. The harness configuration further comprises a service connector configured to manually connect to said servo connector in place of said servo harness connector and provide a third signal to release said braking force.

In yet another aspect of the current disclosure, a marine vessel having a serviceable steering system for a marine pod unit is disclosed. The marine vessel comprises a serviceable steering system which comprises an upper pod unit mounted to a hull of a marine vessel and including a servo motor and a steering brake, a lower pod unit rotatably mounted to said upper pod unit and including a prop section, and a controller electrically connected to said servo motor and to said steering brake via a servo harness connector mated to a servo connector. The servo motor is configured to provide torque for rotating said lower pod unit relative to said upper pod unit upon receiving a first signal from said controller via said servo harness connector. The steering brake configured to provide a braking force to prevent rotation of said lower pod unit when no signal is received, release braking force upon receiving a second signal from said controller via said servo harness connector, and release braking force upon receiving a third signal from a service harness connector, wherein said service harness connector is manually connected in place of said servo harness connector.

DETAILED DESCRIPTION

Figure 1:
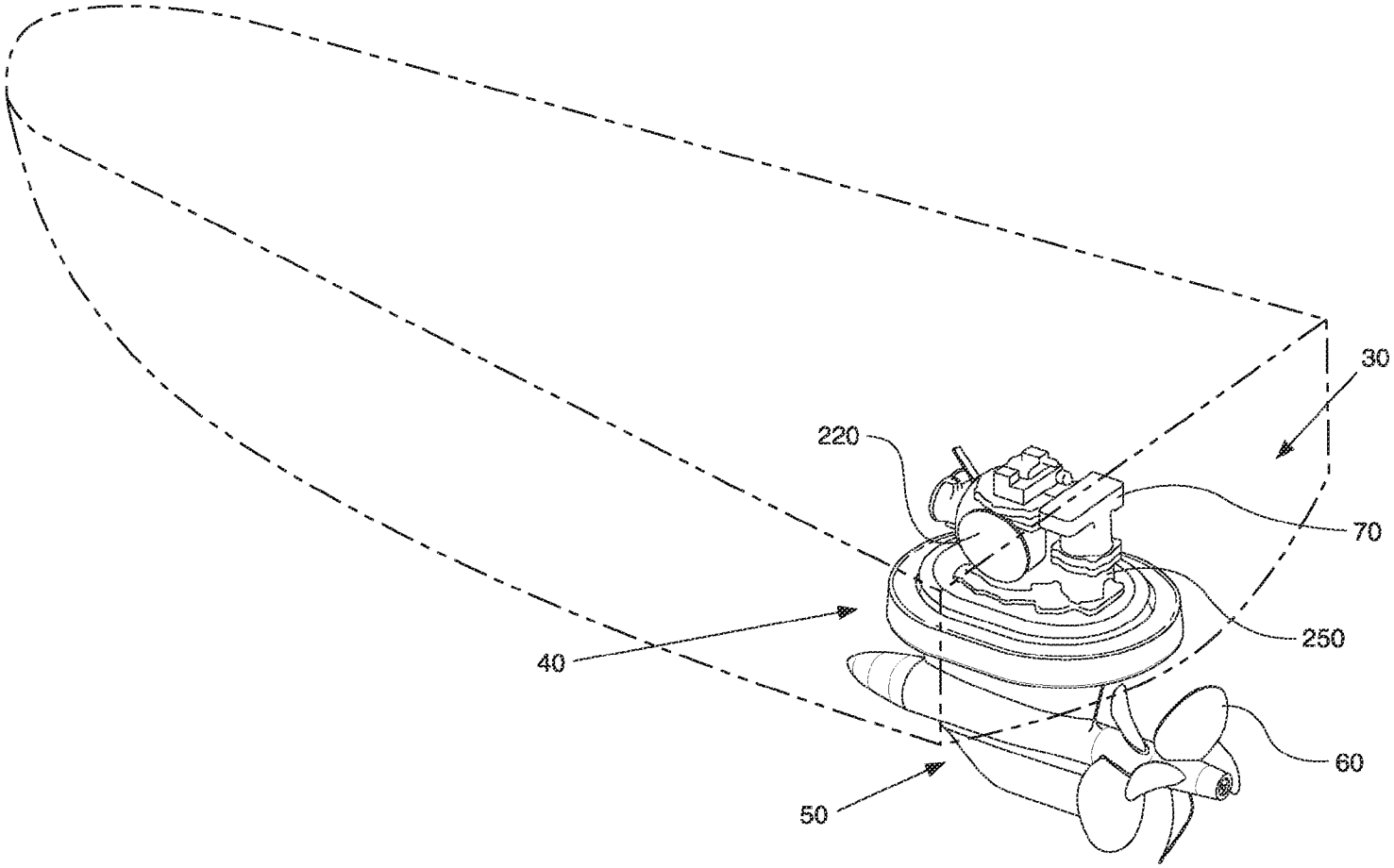
FIG. 1 is a perspective view of a marine pod according to the present disclosure.

A marine vessel 10 is equipped with a pod propulsion system as shown in FIG. 1. The pod 30 provides both propulsion and steering functions for the marine vessel 10. A prime mover, such as an engine or motor, is located in the hull of the marine vessel 10 and is connected to the pod 30 via a driveshaft or gear train and provides propulsive power to the prop section 60.

Figure 2:
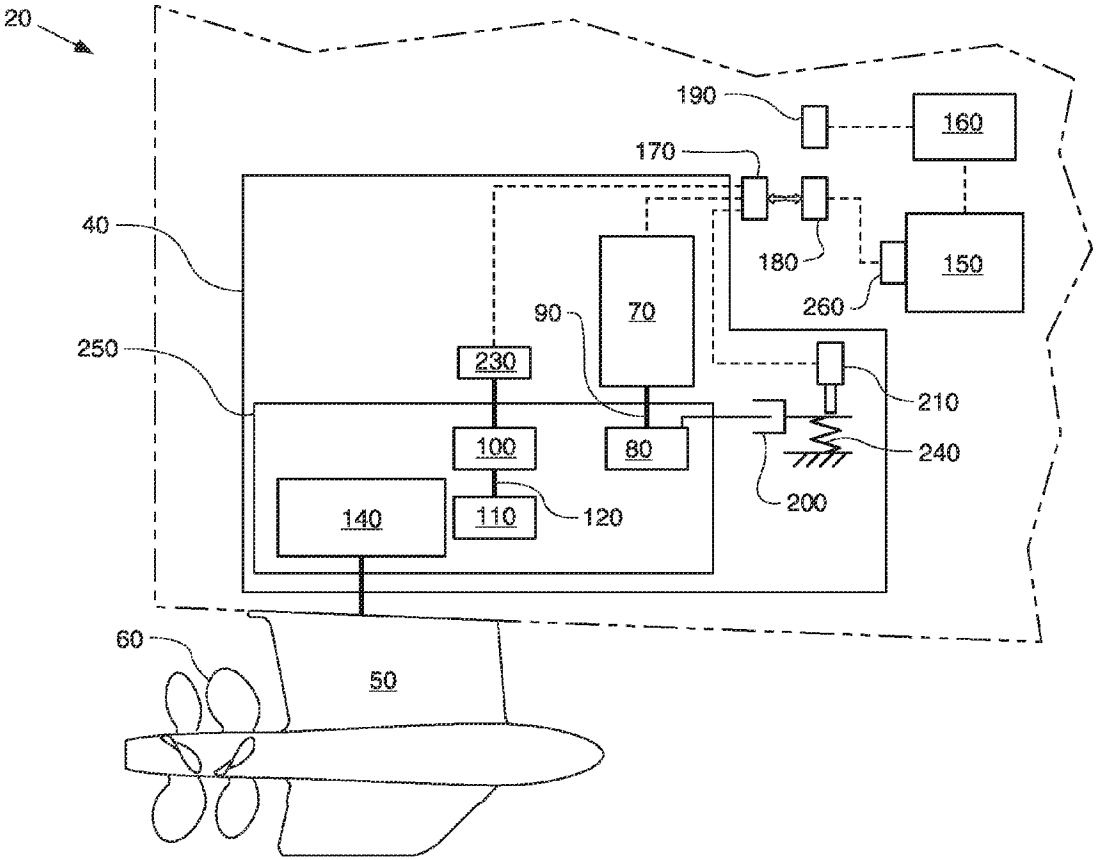
FIG. 2 is a block diagram of a steering system according to the present disclosure.

The pod 30 is divided into an upper pod unit 40 and a lower pod unit 50. The upper pod unit 40 is attached to the hull of the marine vessel 10 and contains gearing and steering functions. See FIG. 2. The prime mover is connected through a gear box and transmitted through a shaft (not shown) to the prop section 60. The upper pod unit 40 also contains a steering gear box 250 that is connected to a servo motor 70. The servo motor 70 provides torque to rotate the lower pod unit 50 relative to the upper pod unit 40 and may be of the DC type. The servo motor 70 includes a servo connector 170 and may also include battery connections. The servo motor 70 further may include hardware for receiving and processing messages from a control area network (CAN) consistent with a J1939 protocol or similar protocol.

The lower pod unit 50 is rotatably attached to the upper pod unit 40 and extends below the hull of the marine vessel 10. The lower pod unit 50 comprises a strut that supports a torpedo-shaped section at its distal end. The torpedo section has a nose cone at a first end and a prop section 60 at a second end. Power is transmitted from the prime mover through a gear box and shafts (not shown) to the prop section 60. The lower pod unit 50 rotates about the upper pod unit 40 to provide steering for the marine vessel 10. The lower pod unit 50 may rotate 360 degrees in some applications or may be limited to 270 degrees of rotation in other applications.

Steering torque is transmitted from servo motor 70 to the lower pod unit 50 through a steering gear box 250. The servo motor 70 connects to a steering pinion gear 80 via a steering pinion shaft 90. The steering pinion gear 80 intermeshes intermediate steering gear 100, which drives intermediate pinion gear 110 through intermediate shaft 120. The intermediate pinion gear 110 intermeshes steering arm gear 140, which rotates the lower pod unit 50.

A steering sensor 130 is configured to detect rotation of the intermediate shaft 120. The steering sensor 130 may be of the mechanical, optical, or magnetic type that is known in the art. As recognized by one skilled in the art, the steering sensor 130 may be attached to any of the gears or shafts in the steering gear box 250.

A spring-applied steering brake 200 is configured to prevent rotation of the steering pinion gear 80 and therefore the servo motor 70. The steering brake 200 operates such that the steering brake 200 is normally engaged by a force applied by brake bias spring 240. The steering brake 200 is disengaged by a force provided by brake solenoid 210 when a current is provided. The steering brake 200 as described is engaged to prevent rotation of the lower pod unit 50 unless a current is provided to the brake solenoid 210. Should the current source or the brake solenoid 210 fail, the steering brake 200 is automatically engaged by the brake bias spring 240.

A controller 150 is provided that is configured to send signals to the servo motor 70 and the brake solenoid 210 and to receive signals from the steering sensor 230. The controller 150 is of the type known in the art and comprises a microprocessor, analog and digital I/O, and internal memory. Part of the I/O may be dedicated to provide a physical layer for communicating on a CAN. The controller 150 may also provide a wakeup signal 290 to the servo motor 70 that will prepare the circuitry in the servo motor 70 for operation. The controller 150 is connected to the servo motor 70 by servo connector 170.

Figure 3:
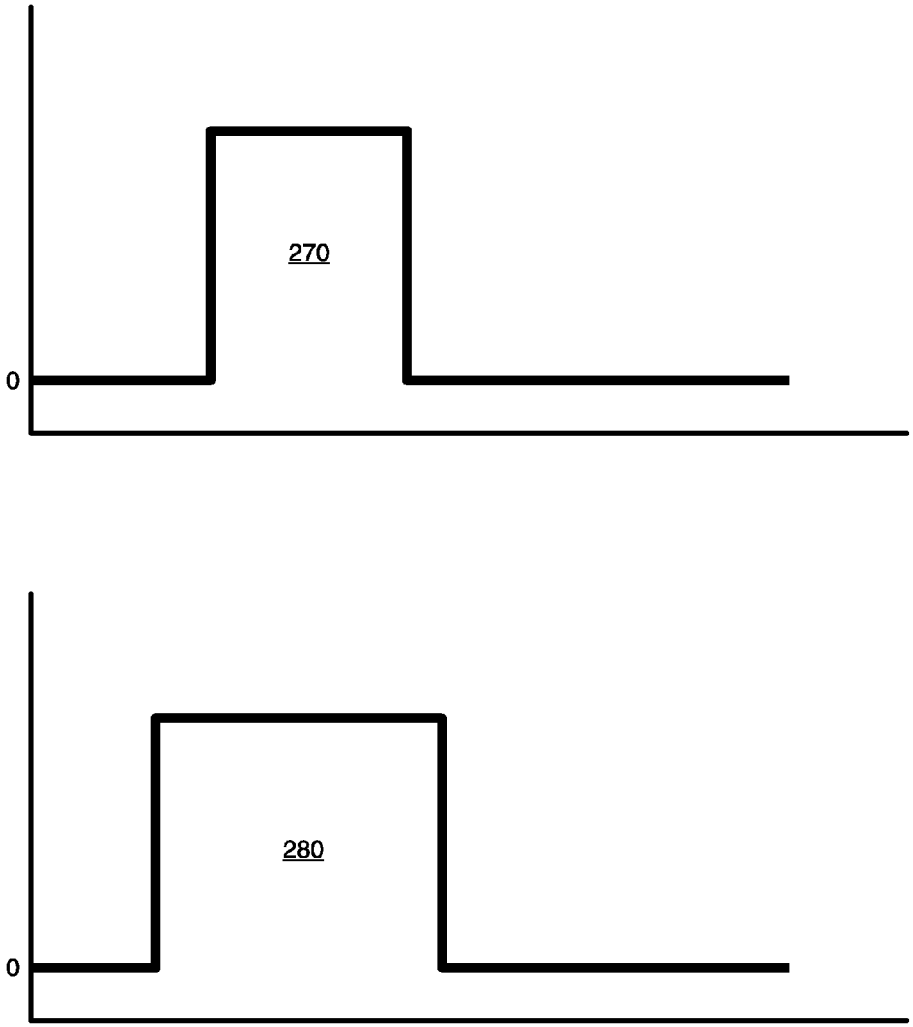
FIG. 3 depicts coterminous servo command and steering brake disengage signals.

When steering is commanded, the controller 150 sends a steering brake disengage signal 280 to the servo motor 70 that provides current to the brake solenoid 210 and releases the steering brake 200. The controller 150 also sends a servo command signal 270 to the servo motor 70 so that the servo motor 70 can provide a steering torque to rotate the lower pod unit 50 relative to the upper pod unit 40. See FIG. 3. The steering brake disengage signal 280 and servo command signal 270 may be sent and received at essentially the same time. In one aspect of the current disclosure, the steering brake disengage signal 280 may be sent and received before the servo command signal 270 is sent and received and may be a longer duration than the servo command signal 270. If the steering brake disengage signal 280 is received first and is of a longer duration, the steering system 20 may avoid wasting energy provided to servo motor 70 before the steering brake 200 is disengaged. In another aspect of the current disclosure, the steering brake disengage signal 280 and the servo command signal 270 may take the form of CAN messages configured to start and stop the steering brake disengage signal 280 and the servo command signal 270.

In certain situations, a fault in the steering system 20 may be detected by the controller 150. The controller 150 may then terminate the steering brake disengage signal 280 in order to engage the steering brake 200 to prevent rotation of the lower pod unit 50. In one example, excessive or uncommanded motion of the lower pod unit 50 may be detected by the steering sensor 230 and the steering brake 200 may be re-engaged to prevent uncommanded steering of the marine vessel 10.

A controller harness is connected to the servo harness connector 180 at a first end and the controller connector 260 at a second end. The servo harness connector 180 provides access to various input/output signals provided by the controller 150, such as the steering brake disengage signal 280, servo command signal 270, and the wakeup signal 290. A service harness connector 190 is provided that can connect to the servo connector 170 in place of the servo harness connector 180. The service harness connector 190 includes pins that connect battery 160 voltage directly to the brake solenoid 210. Further, the service harness connector 190 does not include hardware to provide a steering brake disengage signal 280 and the servo command signal 270. The service harness connector 190 further does not include hardware to provide a wakeup signal 290.

INDUSTRIAL APPLICABILITY

There are times when the steering system 20 must be serviced. During service, different portions of the steering system 20 may need to be isolated for diagnosis or repair. For example, a mechanic may need to rotate the lower pod unit 50 manually during service. This would normally not be possible because the steering brake 200 is normally engaged to prevent rotation of the lower pod unit 50. In addition, it not desirable to have the mechanic in proximity to the steering system 20 during diagnosis or repair in case a fault were to result in uncommanded motion of the steering system 20.

According to the present disclosure, a service harness connector 190 is provided. During service, the servo harness connector 180 is disconnected from the servo connector 170. In this way, the servo motor 70 is no longer connected to the controller 150 and cannot receive a wakeup signal 290 or a servo command signal 270. However, the brake solenoid 210 can now no longer receive current to disengage. Therefore, the service harness connector 190 is manually connected to the servo connector 170 in place of the servo harness connector 180. The service harness connector 190 provides battery 160 voltage to the brake solenoid 210 so that the lower pod unit 50 can be rotated manually. In one aspect of the current disclosure, the lower pod unit 50 may be rotated manually by inserting a ratchet drive into a square drive notch formed into a pinion gear of the servo motor 70 that is accessible from the outside.

What is claimed is:

1. A serviceable steering system for a marine pod unit, comprising:

an upper pod unit mounted to a hull of a marine vessel and including a servo motor and a steering brake;

a lower pod unit rotatably mounted to said upper pod unit and including a prop section;

a controller electrically connected to said servo motor and to said steering brake via a servo harness connector mated to a servo connector;

said servo motor configured to provide torque for rotating said lower pod unit relative to said upper pod unit upon receiving a first signal from said controller via said servo harness connector;

said steering brake configured to prevent rotation of said lower pod unit when no signal is received, allow rotation of said lower pod unit upon receiving a second signal from said controller via said servo harness connector, and allow rotation of said lower pod unit upon receiving a third signal from a service harness connector, wherein said service harness connector is manually connected in place of said servo harness connector.

2. The system of claim 1 wherein the first and second signals are received coterminously.

3. The system of claim 1 wherein said first signal is a control area network (CAN) message.

4. The system of claim 1 wherein said second signal is a control area network (CAN) message.

5. The system of claim 1 wherein said controller is configured, upon detecting a steering system fault, to allow reengagement of said service brake.

6. The system of claim 1 wherein said steering system fault is sensed by a steering sensor.

7. The system of claim 1 wherein said controller is configured to provide a wakeup signal to said servo motor while said servo harness connector is connected to said servo connector.

8. The system of claim 7 wherein said service harness connector is configured not to provide said wakeup signal to said servo motor when said service harness connector is connected to said servo connector.

9. A harness configuration for a steering system for a marine pod unit having an upper pod unit mounted to the hull of a marine vessel and including a servo motor and a steering brake, and a lower pod unit rotatably mounted to said upper pod unit, comprising:

a servo harness connector configured to connect to a servo connector and provide a first signal from a controller to said servo motor, said servo motor configured to provide torque for rotating said lower pod unit relative to said upper pod unit;

said harness connector further configured to connect to said servo connector and provide a second signal from said controller to release said steering brake, said steering brake configured to prevent rotation of said lower pod unit; and a service connector configured to manually connect to said servo connector in place of said servo harness connector and provide a third signal to release said steering brake.

10. The harness configuration of claim 9 wherein the first and second signals are received coterminously.

11. The harness configuration of claim 9 wherein said first signal is a control area network (CAN) message.

12. The harness configuration of claim 9 wherein said second signal is a control area network (CAN) message.

13. The harness configuration of claim 9 wherein said controller is configured, upon detecting a steering system fault, to allow reengagement of said steering brake.

14. The harness configuration of claim 9 wherein said steering system fault is sensed by a steering sensor.

15. The harness configuration of claim 9 wherein said controller is configured to provide a wakeup signal to said servo motor while said servo harness connector is connected to said servo connector.

16. The harness configuration of claim 15 wherein said service harness connector is configured not to provide said wakeup signal to said servo motor when said service harness connector is connected to said servo connector.

17. A marine vessel having a serviceable steering system for a marine pod unit, comprising:

said serviceable steering system comprising:

an upper pod unit mounted to a hull of a marine vessel and including a servo motor and a steering brake;

a lower pod unit rotatably mounted to said upper pod unit and including a prop section;

a controller electrically connected to said servo motor and to said steering brake via a servo harness connector mated to a servo connector;

said servo motor configured to provide torque for rotating said lower pod unit relative to said upper pod unit upon receiving a first signal from said controller via said servo harness connector;

said steering brake configured to prevent rotation of said lower pod unit when no signal is received, allow rotation of said lower pod unit upon receiving a second signal from said controller via said servo harness connector, and allow rotation of said lower pod unit upon receiving a third signal from a service harness connector, wherein said service harness connector is manually connected in place of said servo harness connector.

18. The marine vessel of claim 17 wherein the first and second signals are received coterminously.

19. The marine vessel of claim 17 wherein said first signal is a control area network (CAN) message.

20. The marine vessel of claim 17 wherein said second signal is a control area network (CAN) message.

* * * * *